US005626240A

United States Patent [19]

Friedrichs et al.

[11] Patent Number: 5,626,240

[45] Date of Patent: May 6, 1997

[54] UNIT FOR SEPARATING WASTE AND VALUABLE MATERIALS

[75] Inventors: Oliver K. Friedrichs, Düsseldorf, Germany; Nicholas B. White, Lancashire, Great Britain

[73] Assignees: Lune Objekteinrichtung GmbH; Lune Metal Products Co., Ltd, both of Lancashire, England

[21] Appl. No.: 286,877

[22] Filed: Aug. 5, 1994

[30] Foreign Application Priority Data

Aug. 13, 1993 [DE] Germany ..... 9312129 U

[51] Int. Cl.[6] ..... B07C 7/04

[52] U.S. Cl. ..... 209/702; 209/930; 220/23.83; 220/909

[58] Field of Search ..... 209/930, 942, 209/702; 220/908, 909, 404, 475, 23.2, 23.4, 23.6, 23.83, 23.86

[56] References Cited

U.S. PATENT DOCUMENTS

| | | | |
|---|---|---|---|
| 4,974,746 | 12/1990 | Dickinson | 209/930 X |
| 5,050,755 | 9/1991 | Strawder | 220/909 X |
| 5,067,626 | 11/1991 | Leumi | 220/908 X |
| 5,101,997 | 4/1992 | Bagwell et al. | 220/23.83 X |
| 5,172,824 | 12/1992 | Stutler | 209/930 X |
| 5,221,010 | 6/1993 | Bianco | 209/702 |
| 5,246,119 | 9/1993 | Heffner | 209/702 |
| 5,294,012 | 3/1994 | Shott et al. | 220/909 X |
| 5,328,028 | 7/1994 | Hale et al. | 220/908 X |
| 5,381,916 | 1/1995 | Strawder | 220/909 X |
| 5,390,813 | 2/1995 | Anderson et al. | 220/909 X |
| 5,392,926 | 2/1995 | Schafer | 209/930 X |

FOREIGN PATENT DOCUMENTS

| | | | |
|---|---|---|---|
| 769407 | 7/1971 | Belgium . | |
| 3222086 | 12/1983 | Germany | 220/909 |
| 8517745 | 10/1985 | Germany . | |
| 9102304 | 6/1991 | Germany . | |
| 9205597 | 8/1992 | Germany . | |
| 9312129 | 12/1993 | Germany . | |
| 9013498 | 11/1990 | WIPO | 220/908 |

*Primary Examiner*—D. Glenn Dayoan
*Attorney, Agent, or Firm*—Darby & Darby, PC

[57] ABSTRACT

A unit for separating waste and valuable materials with several mutually connected waste containers, which are equipped with identifying features labeling these waste containers for the purpose of assigning a particular waste or recyclable fraction to them. The unit for separating waste and valuable materials is constructed so as to be adaptable in modular fashion.

18 Claims, 13 Drawing Sheets

Fig. 4
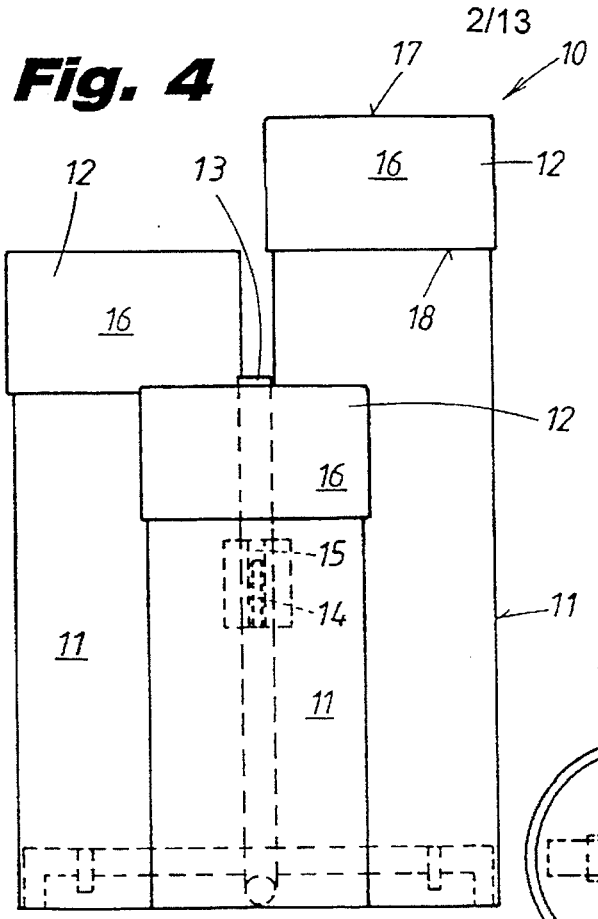
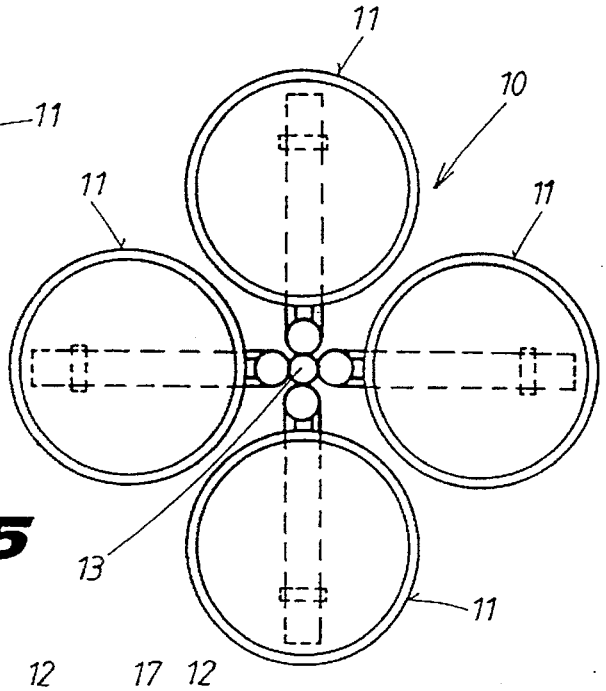
Fig. 5
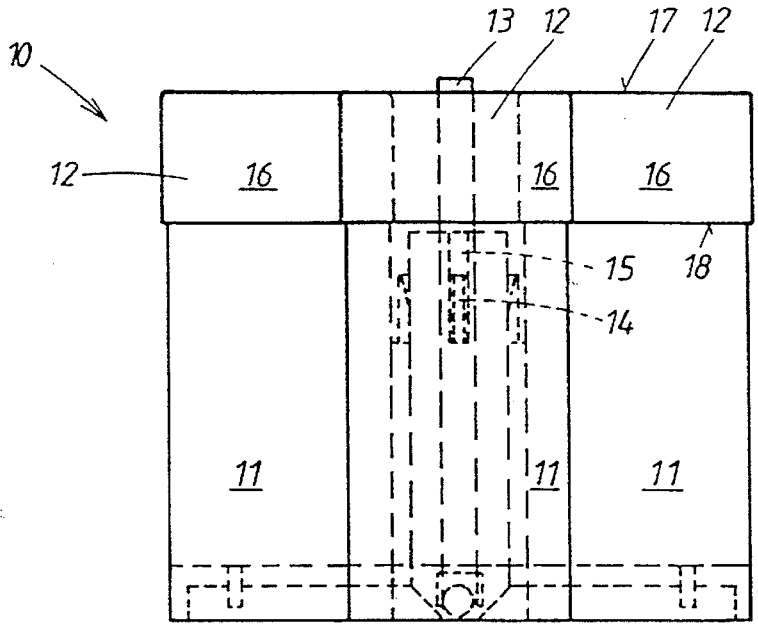
Fig. 6

UNIT FOR SEPARATING WASTE AND VALUABLE MATERIALS

FIELD OF THE INVENTION

The invention relates to a unit for separating waste and valuable materials, with several, mutually connected waste containers, which are equipped with identifying means labeling these waste containers for the purpose of assigning a particular waste or recyclable fraction to them.

BACKGROUND OF THE INVENTION

Various versions of units for separating waste and valuable materials are known, from the state of the art. These consist either of a repeatedly divided container or of several waste containers or receptacle fixtures, which are connected to one another, for example, over a center post. Materials are assigned to a particular valuable or recyclable fraction mostly nonuniformly with the help of inscriptions and pictograms on or in the containers or by way of inscriptions and shaped incisions on accessories, which are firmly connected with the containers. Such embodiments of units for separating waste and valuable materials have the advantage of making it possible to assign to a particular valuable material or recyclable fraction and also of indicating this fraction unambiguously. Because they are constructed in one piece they have, however, the serious disadvantage that, once set up, they are restricted to certain material volumes and fractions. These embodiments can be modified and thus adapted to other circumstances only with appreciable technical effort, if at all.

It is an object of the invention to retain the previous advantages and to improve the known embodiments of a unit for separating waste and valuable materials, so that they can be produced as easily and economically as possible and adapted to new circumstances without technical effort and without problems. It shall, moreover, be possible to make such an adaptation to a different composition of waste materials with respect to the type and number, as well as to the amounts of the waste and valuable materials.

SUMMARY OF THE INVENTION

Pursuant to the invention, this objective is accomplished owing to the fact that the unit for separating waste and valuable materials is constructed so as to be adaptable in modular fashion. By means of this development, a unit for separating waste and valuable materials, which can be manufactured simply and economically using a few modular elements, is created for the first time in a simple manner. Moreover, the unit for separating waste and valuable materials can be modified on location without the help of tools, for example, by mechanically unskilled persons, with respect to the nature and number as well as to the amounts of waste and valuable materials.

In the case of a preferred embodiment of the invention, the unit for separating waste and valuable materials has tubular waste containers. Advisably, the waste containers of the unit for separating waste and valuable materials are constructed in tubular fashion and can be assembled in modular fashion over a center post, so that, for example, for adapting the volume, a container is simply removed from the holding device of the center post and exchanged for a container with a different capacity. In this connection, it is advisable that the waste containers interact over sliding elements attached to them with vertical guide rails disposed on the center post.

According to a further distinguishing feature of the invention, it is advisable that the identifying means labeling the waste containers be constructed as interchangeable rings, which can be mounted in modular fashion on the waste containers. The use of such interchangeable rings offers various advantages:

By exchanging existing interchangeable rings for rings with the color and inscription of a different material fraction, the unit can be adapted without changing the capacity to a new requirement, so that containers for new valuable or recyclable fractions can be installed without difficulty. A further advantage consists therein that, due to the use of interchangeable rings, containers uniform with respect to their color can be used. Unnecessarily large numbers of containers need therefore not be kept in stock, since every container can be used for each valuable or waste material fraction. In this connection, it is advisable that the interchangeable rings, which can be mounted in modular fashion on the waste containers, be constructed for the purpose of holding the bags for the waste that are to be brought into the working container in such a way, that their one end forms a flange around the upper limiting edge of the respective waste container and the other end extends over the other end over a region of the outer surface of the waste container. By these means, it is avoided that parts of the bag for the waste in the waste container are visible from the outside.

According to a further characteristic of the invention, the unit for separating waste and valuable materials has a total of three tubular waste containers.

For a different embodiment of the invention, the unit for separating valuable and waste materials has a total of four tubular waste containers. The center post, belonging to the respective embodiment, is constructed in accordance with the circumstances. Due to the modular adaptability of the unit for separating waste and valuable materials, the realization of embodiments with a larger number of waste containers is also possible.

The waste containers of the unit for separating waste and valuable materials can have the same height. According to a further distinguishing feature of the present invention, it is, however, also possible that the waste containers of the unit for separating waste and valuable materials have a different height. In this case, for example, by a step-shaped construction, an additional psychological aspect is taken into consideration in that, in order to avoid waste, a higher capacity is offered to the user for valuable materials than for recyclable materials. This can be achieved particularly clearly, for example, by a staircase-like arrangement of the waste containers.

It is furthermore advisable that the waste containers of the unit for separating waste and valuable materials have a different diameter, so that adaptation to the largest possible number of different circumstances can be achieved.

According to a further characteristic of the invention, the unit for separating waste and valuable materials can be equipped with a locking device, in order to achieve protection against vandalism and theft. In this connection, it is advisable that the locking device of the unit for separating waste and valuable materials consists of an extension of the center post and an interchangeable pipe, which can be shifted thereon, interacts with the waste containers and their interchangeable rings and has a number of claws corresponding to the number of waste containers for securing the waste containers and their interchangeable rings, and of a cylinder lock. By these means, this locking device can be constructed essentially in one part for all variations, opened by means of a key and pushed upwards. The simultaneous unlocking of all waste containers and interchangeable rings becomes possible in this way.

The locking device is intended to be used for all embodiments of a unit for separating waste and valuable materials. According to a further proposal of the invention, the displaceable, interchangeable pipe of the locking device of the unit for separating waste and valuable materials is equipped, for use with waste containers of different height, with a number of claws disposed at different heights and corresponding to the number of waste containers.

According to a further proposal of the invention, it is advisable that the unit for separating waste and valuable materials be equipped with a roof construction. For units, which are intended to be set up outside, such a development offers protection particularly against rainwater. In this connection, it is advisable that the roof construction for the unit for separating waste and valuable materials is constructed as a curved, dome-shaped roof. By these means, it is avoided that objects can be set down on the unit itself and must instead necessarily be disposed of in the unit itself. In this connection, it is advisable that the curved, dome-shaped roof has along the center axis a stay pipe, which interacts with an extension, which can be placed on the center post.

According to a further proposal of the invention, the unit for separating waste and valuable materials is equipped with a pictogram holder. Advisably, the pictogram holder has along the center axis a stay pipe, which interacts with an elongation extending so as to be at the eye level of the user. A pictogram holder, mounted above eye level on such an extended center post, shows from afar and also in areas of high public traffic that waste and valuable materials can be disposed of by type at the appropriate place.

As an alternative to the embodiment with the roof construction, it is proposed according to a further characteristic of the invention to equip the unit for separating waste and valuable materials with an ashtray.

According to a last proposal of the invention, the unit for separating waste and valuable materials is equipped with an ashtray and a pictogram holder.

BRIEF DESCRIPTION OF THE DRAWINGS

Several embodiments of the invention are shown in the Figures of the drawing, in which FIG. 4 shows a side view of a modified embodiment of a unit for separating waste and valuable materials with three containers for waste of different height, FIG. 5 shows a plan view of a second embodiment of an inventive unit for separating waste and valuable materials with four containers for waste, FIG. 6 shows a side view of the second embodiment of a unit for separating waste and valuable materials.

DESCRIPTION OF THE PREFERRED EMBODIMENTS

Figure 1:
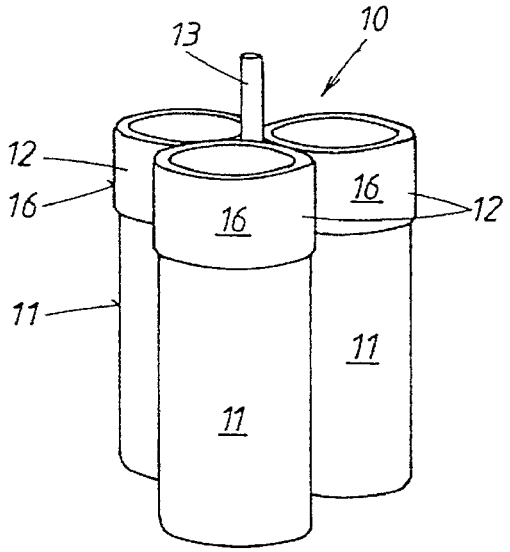
FIG. 1 shows a first embodiment of the inventive unit for separating waste and valuable materials with three containers for waste in a perspective representation.

The unit for separating waste and valuable materials shown in FIG. 1 is labeled 10 as a whole. This unit for separating waste and valuable materials 10 is constructed to be adaptable in modular fashion and has, in the embodiment shown in the drawing of FIG. 1, three containers 11 for waste, which are hollow objects and tubular in this case. These containers 11 for waste of the unit for separating waste and valuable materials 10 can be made from perforated or slotted solid sheet metal. They are connected together over a center post 13 in such a way, that they can be assembled in modular fashion. Moreover, for the purpose of assigning them to a particular valuable or recyclable fraction, the waste containers 11 are labeled with identifying means 12.

These identifying means 12, which label the containers 11 for the waste, are constructed as interchangeable rings 16, which can be mounted on the waste containers 11. In the embodiments shown in the Figures of the drawing, such as FIG. 3, the interchangeable rings 16, which can be mounted on the waste containers 11 in modular fashion, are constructed for the purpose of holding bags for the waste, which can be brought into the waste containers 11, but are not shown in the Figures of the drawing, in such a way that their one end 17 is flanged around the upper limiting edge of the corresponding waste container 11 and the other end extends over a region of the outer surface of the waste container. By these means, it is achieved that the bag for the waste, which is in the waste container 11, cannot be seen from the outside.

For the embodiments shown in the Figures of the drawings, the waste containers 11 of the unit for separating waste and valuable materials 10 can be assembled in modular fashion by way of a center post 13 in such a manner, that the waste containers 11 interact over sliding elements 14 fastened to the waste container 11 with vertical guide rails 15 disposed on this center post 13. For the embodiment shown, the center post 13 has a number of unlabeled stand feet, which corresponds to the number of waste containers 11, as can be seen, for example, in FIGS. 2 and 5 of the drawing. In the last case mentioned, the unit for separating waste and valuable materials 10 has a total of four waste containers 11.

Figure 2:
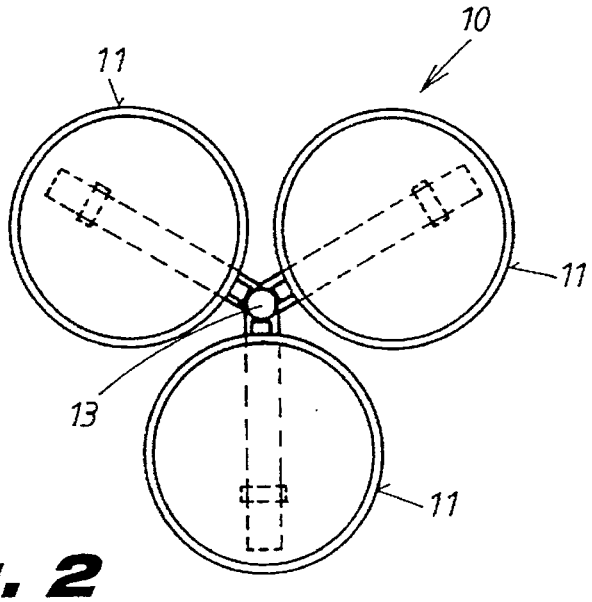
FIG. 2 shows a plan view of this first embodiment of a unit for separating waste and valuable materials with three containers for waste.
Figure 3:
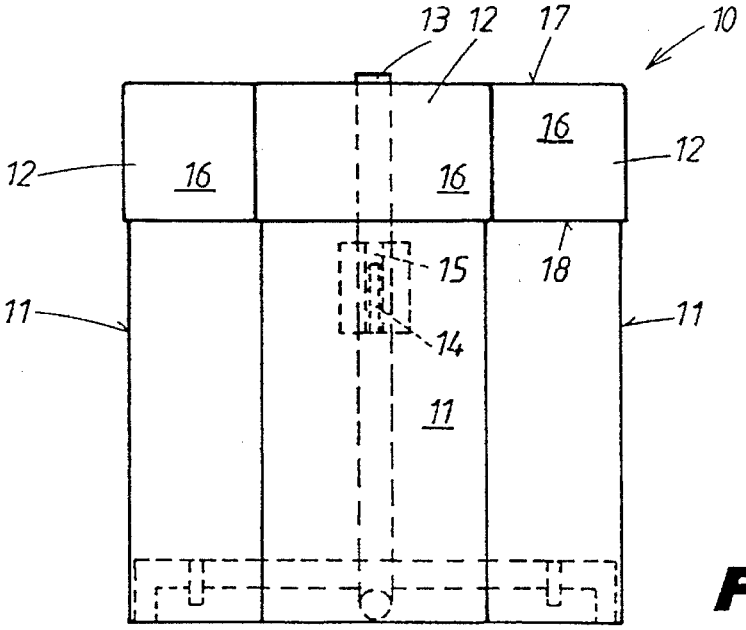
FIG. 3 shows a side view of this first embodiment.

For the first embodiment of the inventive unit for separating waste and valuable materials 10, shown in FIGS. 1 to 3 of the drawing, the waste containers 11 can have a variable height, as well as a different diameter. In the latter case, all the waste containers have the same height.

For a modified first embodiment of the inventive unit for separating waste and valuable materials 10, the three waste containers 11 present have different heights, so that, when viewed as a whole, a step construction results, as shown in FIG. 4 of the drawing.

A second embodiment of the inventive unit for separating waste and valuable materials 10 is shown in FIGS. 5 and 6. In this case, a total of four waste containers 11 is provided. They can be assembled in modular fashion by way of a center post 13 with four stand feet in such a manner that once again the waste containers 11 interact over sliding elements 14 fastened to them with vertical guide rails 15, which are disposed on the center post 13. For this embodiment also, it is planned that waste containers of variable height be used. Seen as a whole, all waste containers 11 have the same height.

Figure 7:
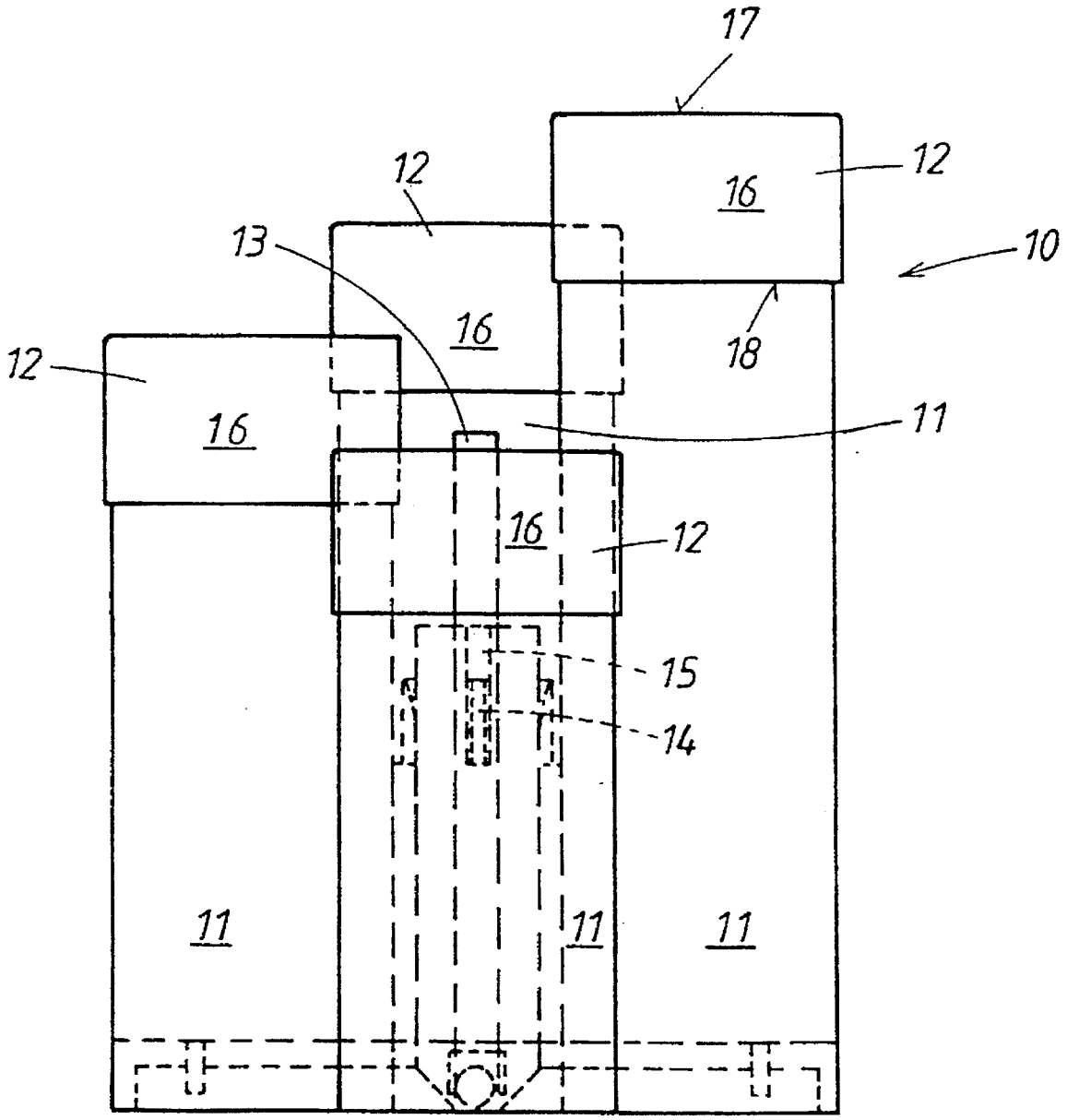
FIG. 7 shows a side view of a modified embodiment of a unit for separating waste and valuable materials with four containers for waste of different height.

For a modified, second embodiment of the unit for separating waste and valuable materials 10 of FIG. 7 of the drawing, the waste containers 11 have different heights, as a result of which a step-like construction results. By means of such a construction, a psychological effect is achieved owing to the fact that, for example, in order to avoid waste, a larger capacity is offered to the user for valuable materials than for recyclable materials.

For the embodiments of the unit for separating waste and valuable materials 10 with four waste containers 11, it is also planned to let the waste containers 11 have different diameters, so that waste containers 11 of different construction can be assembled together over the center post 13.

Figure 8:
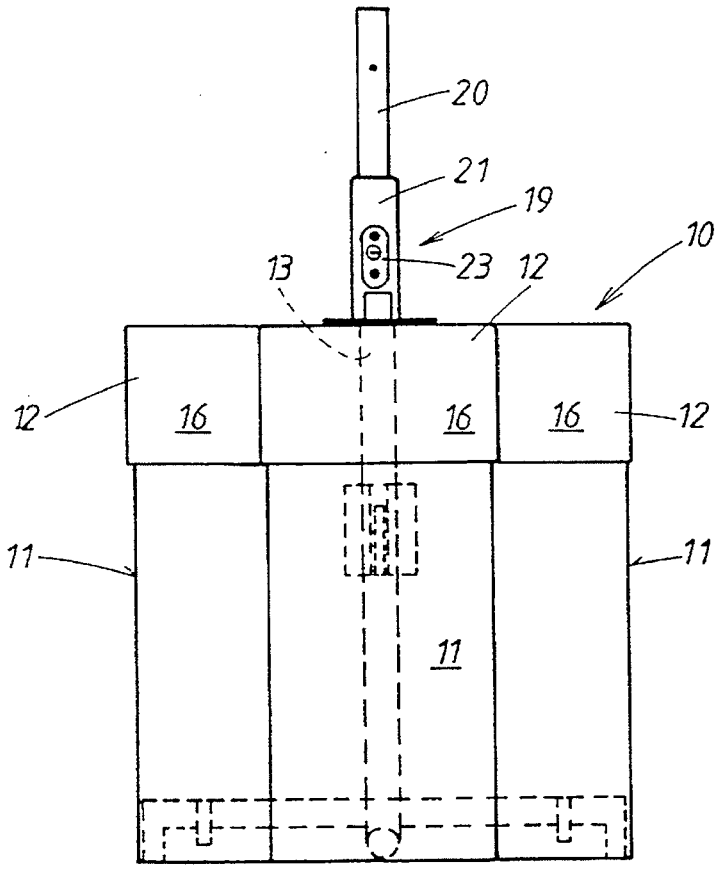
FIG. 8 shows a side view of a third embodiment of the inventive unit for separating waste and valuable materials with three containers for waste and a locking device.
Figure 9:
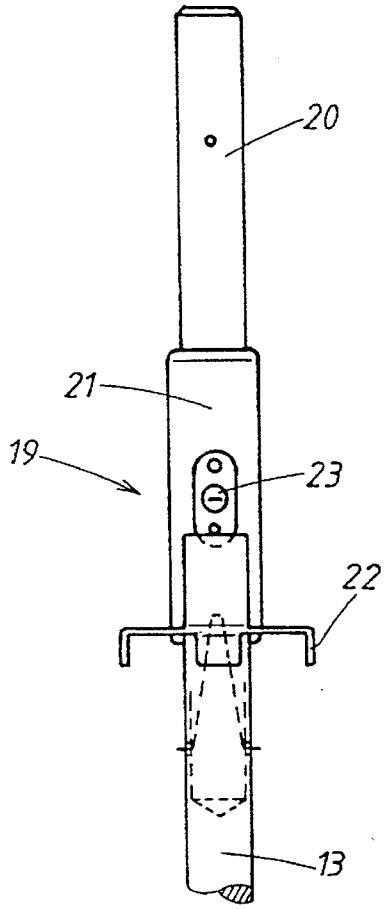
FIG. 9 shows a representation of this locking device for the inventive unit for separating waste and valuable materials.
Figure 10:
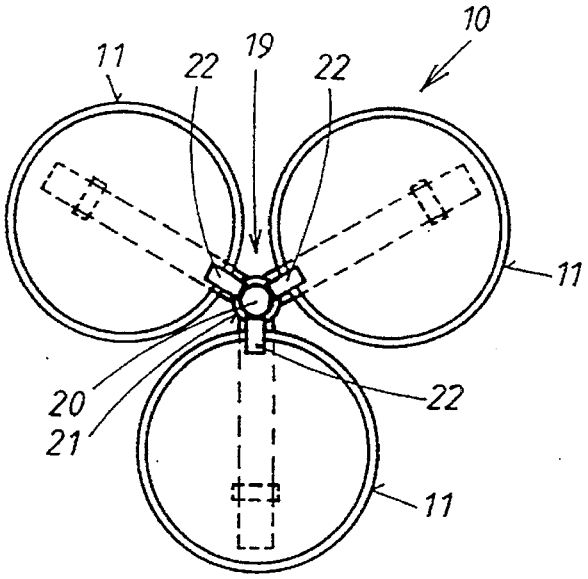
FIG. 10 shows a plan view of the third embodiment of the unit for separating waste and valuable materials of FIG. 8.

A third embodiment of the inventive unit for separating waste and valuable materials 10 is shown in FIG. 8 of the drawing. In this case, the unit for separating waste and valuable materials 10 has a locking device 19. As also shown in FIG. 9, this locking device of the unit for separating waste and valuable materials 10 consists of an extension 20 of the center post 13 and of an interchangeable pipe 21, which is displaceable on the center post 13, interacts with the waste container 11 and its interchangeable rings 16 and has a number of claws 22 (see FIG. 10 of the drawing), in this case three, corresponding to the number of waste containers 11, for securing the waste containers 11 and their interchangeable rings 16. In addition, the interchangeable pipe 21 has a cylinder lock 23, which is unlocked with a key and can be locked simply by inserting the opened lock cylinder. The extension 20 of the center post 13 is pushed from above onto the center post 13 and fixed with spring-assisted securing pins, which are not shown in the Figures of the drawing.

Figure 11:
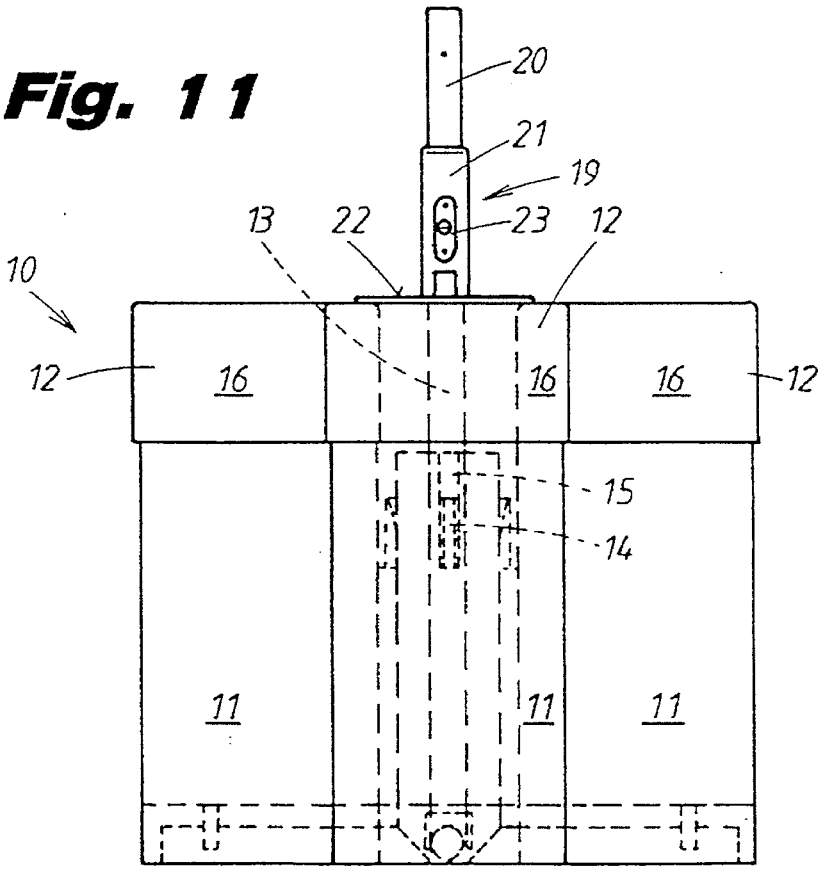
FIG. 11 shows a side view of a fourth embodiment of an inventive unit for separating waste and valuable materials with four containers for waste and a locking device.
Figure 12:
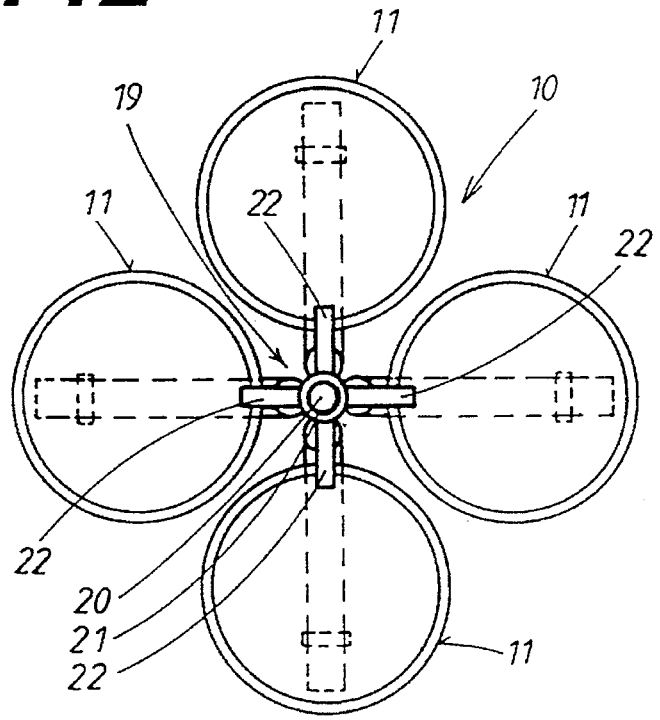
FIG. 12 shows a plan view of the embodiment of FIG. 11.

FIGS. 11 and 12 show a fourth embodiment of the inventive unit for separating waste and valuable materials 10. In this case, the unit for separating waste and valuable materials 10, equipped with a locking device 19, has a total of four waste containers 11. The number of claws 22, interacting with the waste containers 11 and their interchangeable rings 16, corresponds to the number of waste containers 11, that is, four in this case.

Figure 13:
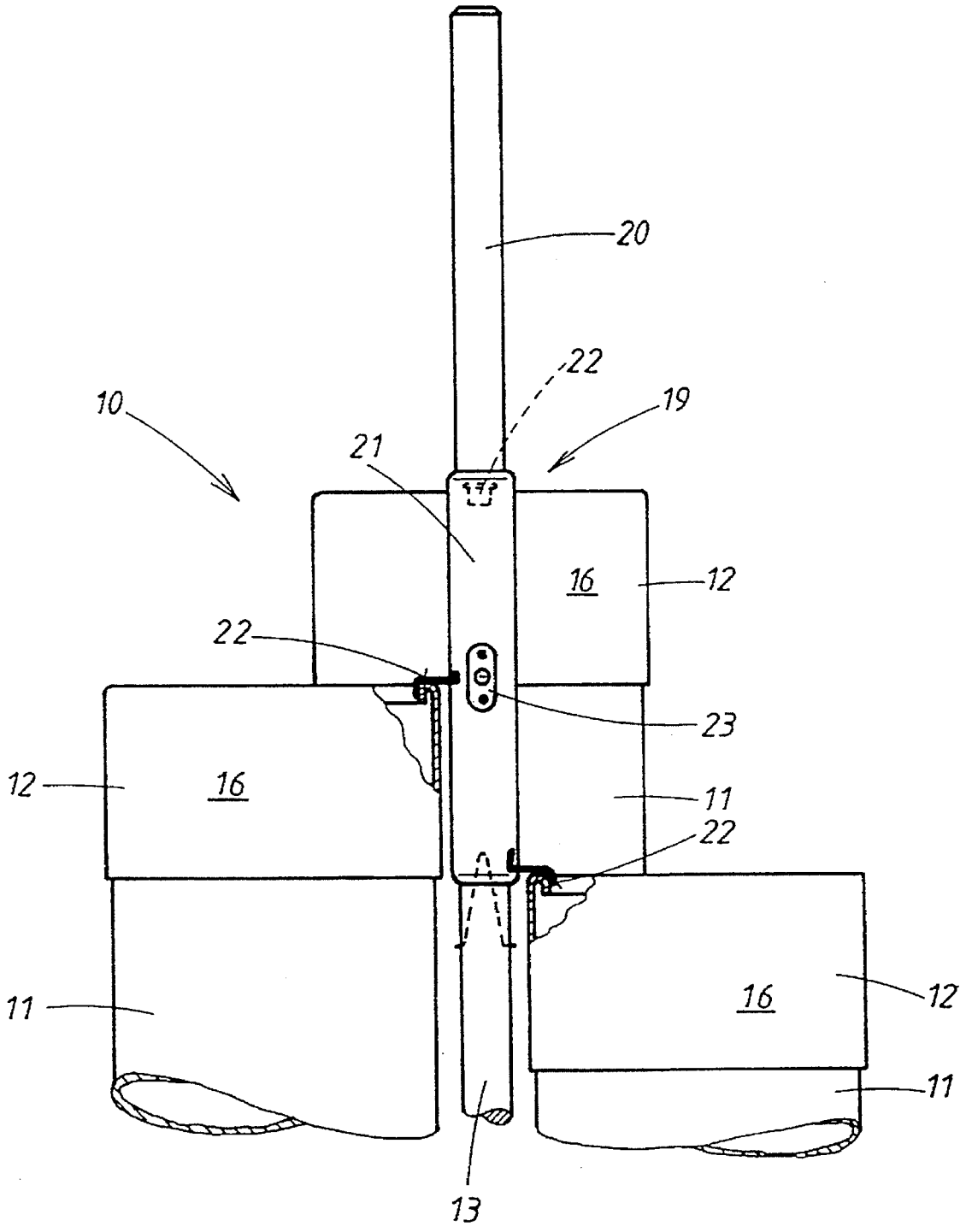
FIG. 13 shows a modified embodiment of the unit for separating waste and valuable materials of FIGS. 8 and 10 with three containers for waste of different height and an associated locking device.

FIG. 13 of the drawing shows a modified, third embodiment of the unit for separating waste and valuable materials 10. In this case, so that the embodiment can be used with three waste containers 11 of different height, the movable, interchangeable pipe 21 of the locking device 19 of the unit for separating waste and valuable materials 10 is equipped with three claws 22, which are disposed at different heights corresponding to the height of the respective waste container 11. The simultaneous unlocking of all waste containers 11 and of the interchangeable rings 16 on the waste containers 11 is thus made possible also in this case.

Figure 15:
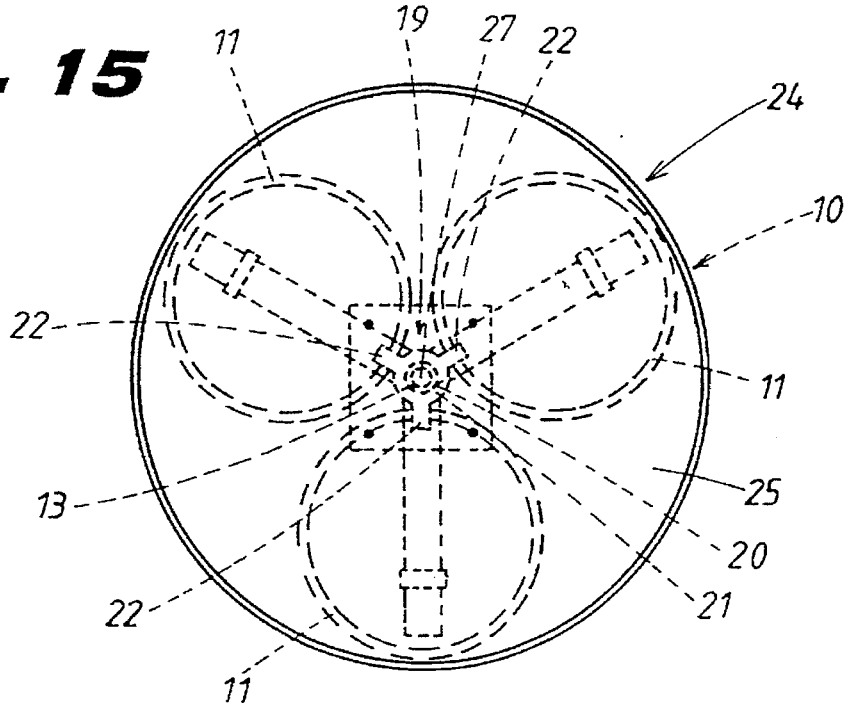
FIG. 15 shows a plan view of the embodiment of FIG. 14.
Figure 14:
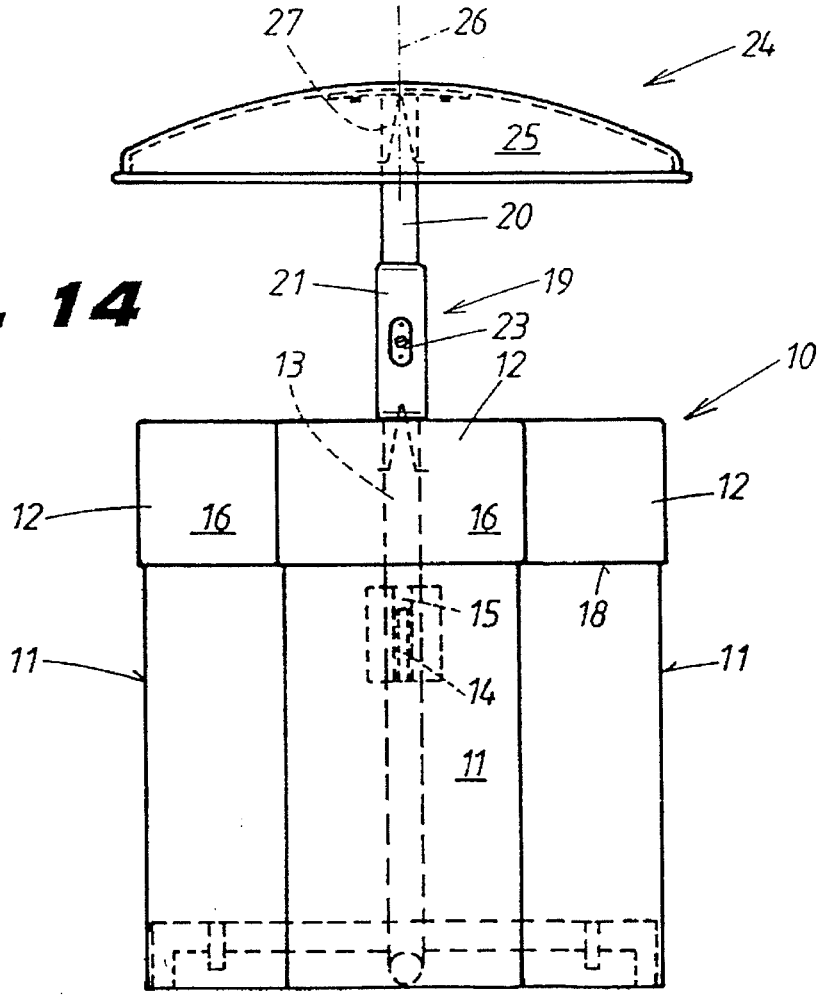
FIG. 14 shows a side view of a fifth embodiment of an inventive unit for separating waste and valuable materials with three waste containers, a locking device and a roof construction.

In FIGS. 14 and 15 of the drawing, a fifth embodiment of the inventive unit for separating waste and valuable materials 10 is shown. In this case, the unit for separating waste and valuable materials 10 is equipped with a roof construction 24, which is constructed for the embodiment shown as a curved, dome-shaped roof 25. This curved, dome-shaped roof 25 has along its center axis 26 a stay pipe 27, which interacts with an extension 20, which can be placed upon the center post 13 of the unit for separating waste and valuable materials 10. The stay pipe 27 is pushed from above into the mounted extension 20 and fixed with spring-assisted securing pins. For the embodiment shown, the unit for separating waste and valuable materials 10, equipped with the roof construction 24, also has a locking device 19 as well as waste containers 11 of equal height. However, different embodiments, for example, with waste containers 11 of different height, which can also have different diameters, and also one embodiment without locking device 19 are planned here.

Figure 17:
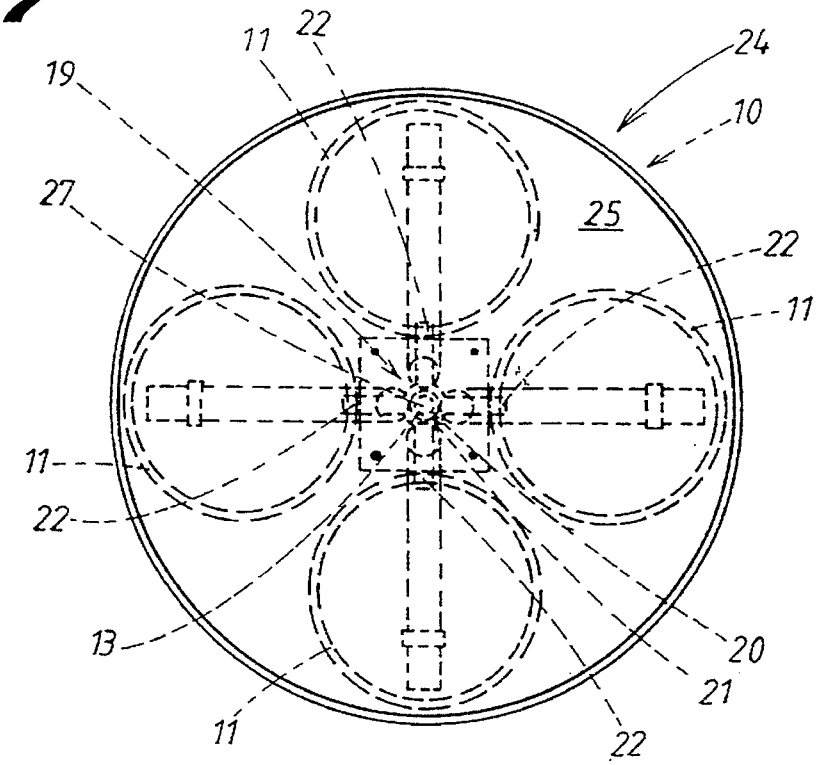
FIG. 17 shows a plan view of this sixth embodiment of FIG. 16.
Figure 16:
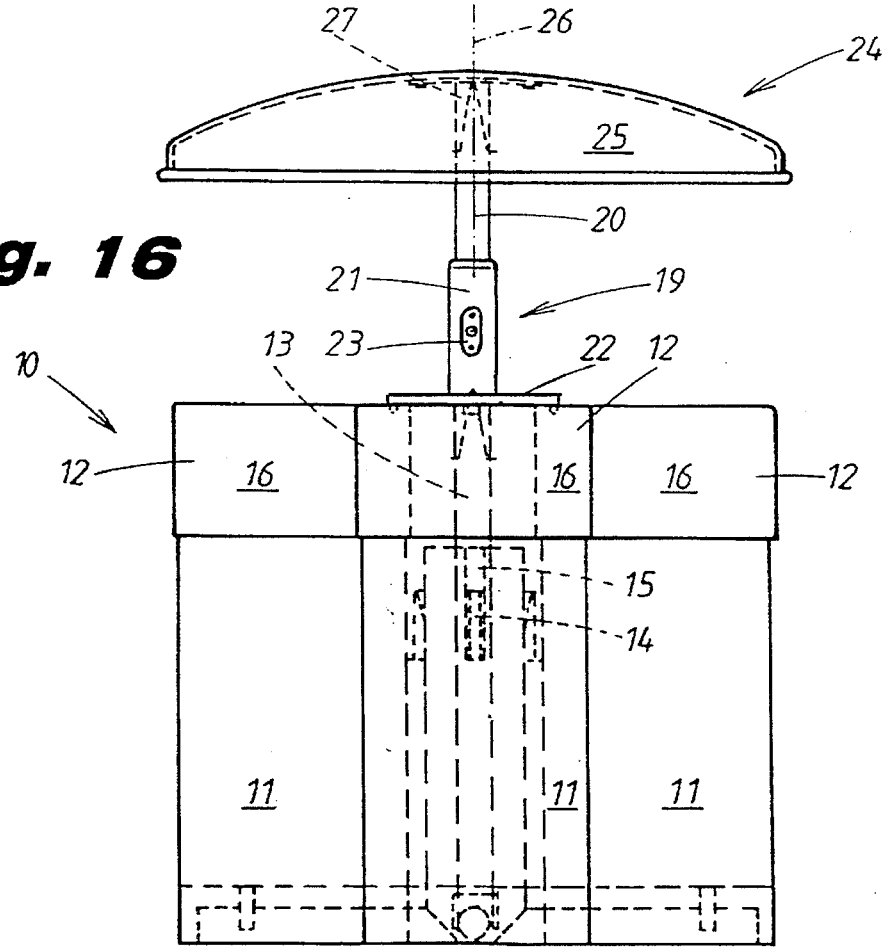
FIG. 16 shows a side view of a sixth embodiment of the unit for separating waste and valuable materials with four containers for waste, a locking device and a roof construction.

FIGS. 16 and 17 show a sixth embodiment of the unit for separating waste and valuable materials 10 and, moreover, one with four waste containers 11, one locking device 19 and a roof construction 24 in the form of a curved dome-shaped roof 25. The curvature of the surface of the roof construction 24 offers the advantage that objects cannot be set down on the unit for separating waste and valuable materials 10, but must be disposed of in said unit itself. Waste containers 11 of different height or with different diameters can also be provided for this embodiment. Moreover, the locking device 19 can be omitted.

Figure 18:
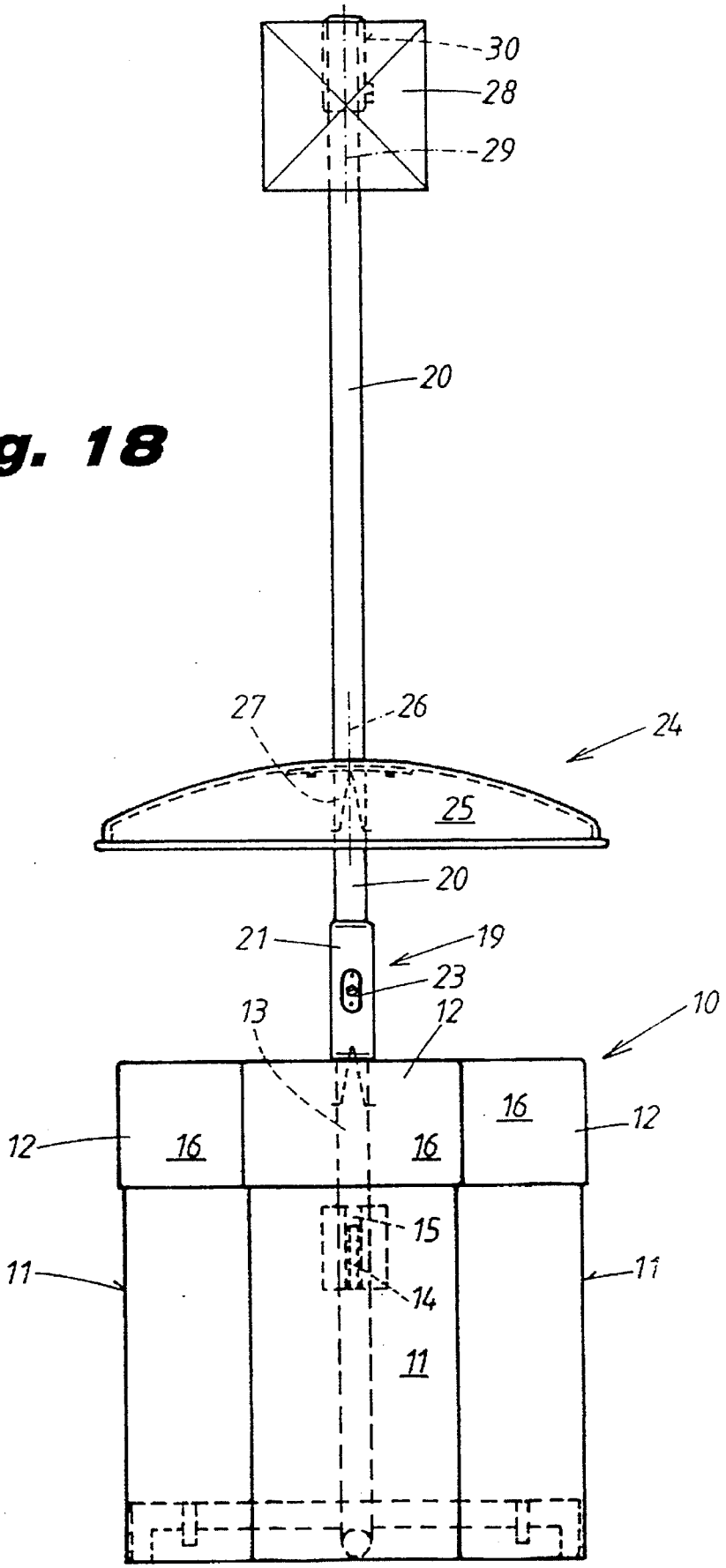
FIG. 18 shows a side view of a seventh embodiment of the unit for separating waste and valuable materials with three containers for waste, one locking unit, one roof construction and one pictogram holder.
Figure 19:
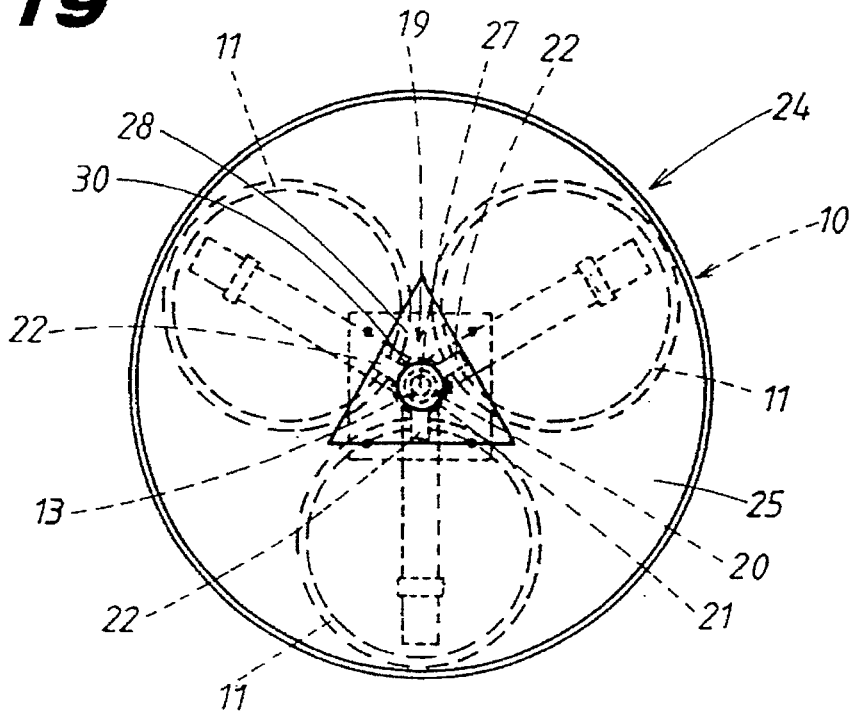
FIG. 19 shows a plan view of the embodiment of the unit for separating waste and valuable materials of FIG. 18.

A seventh embodiment of the unit for separating waste and valuable materials 10 is shown in FIGS. 18 and 19. In this case, said unit is equipped with three waste containers 11 with a pictogram holder 28, which along its center axis 29 has a stay pipe 30, which interacts with an extension 20, which can be placed on the center post 13 and extends up to the eye level of the user. The extension 20, which extends up to the eye level of the user, either is pushed onto the center post 13 and fixed with spring-assisted securing pins or pushed in the center of the curved, dome-shaped roof 25 from above into the stay pipe 27 and fixed there with spring-assisted securing pins. Seen in plan view, the pictogram holder 28 has a geometric, shape representing the number of waste containers 11, such as a triangular shape. In FIG. 18 of the drawing, waste containers 11 of the same height, a locking device 19 and a roof construction 24 in conjunction with the pictogram holder 28 are provided. In deviation from the preceding, different combinations and variations of these components are also conceivable.

Figure 21:
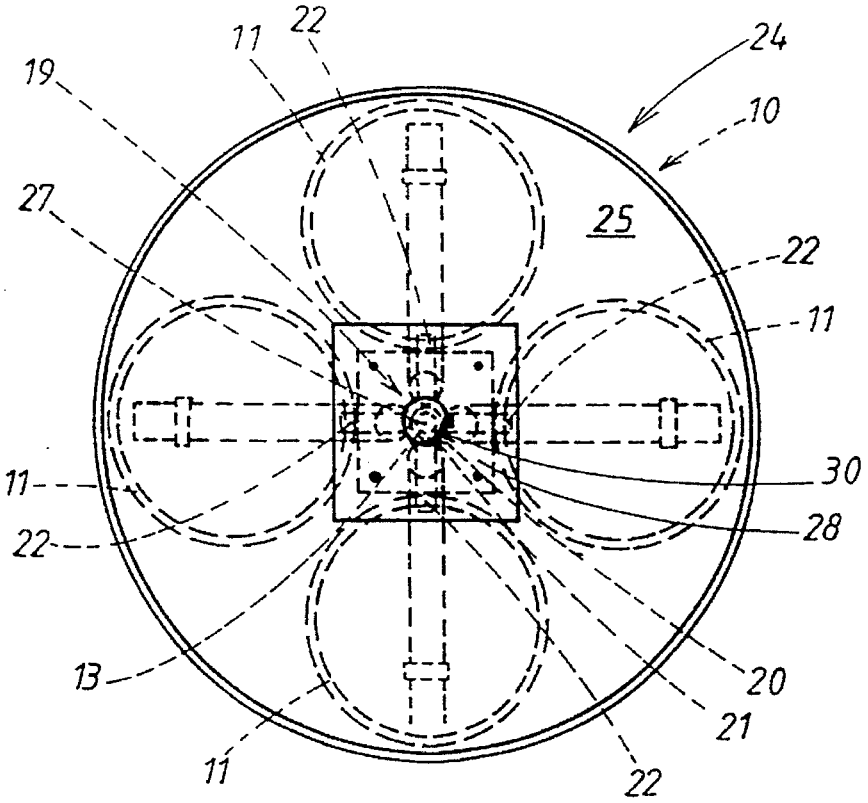
FIG. 21 shows a plan view of the eighth embodiment of the unit for separating waste and valuable materials of FIG. 20.
Figure 20:
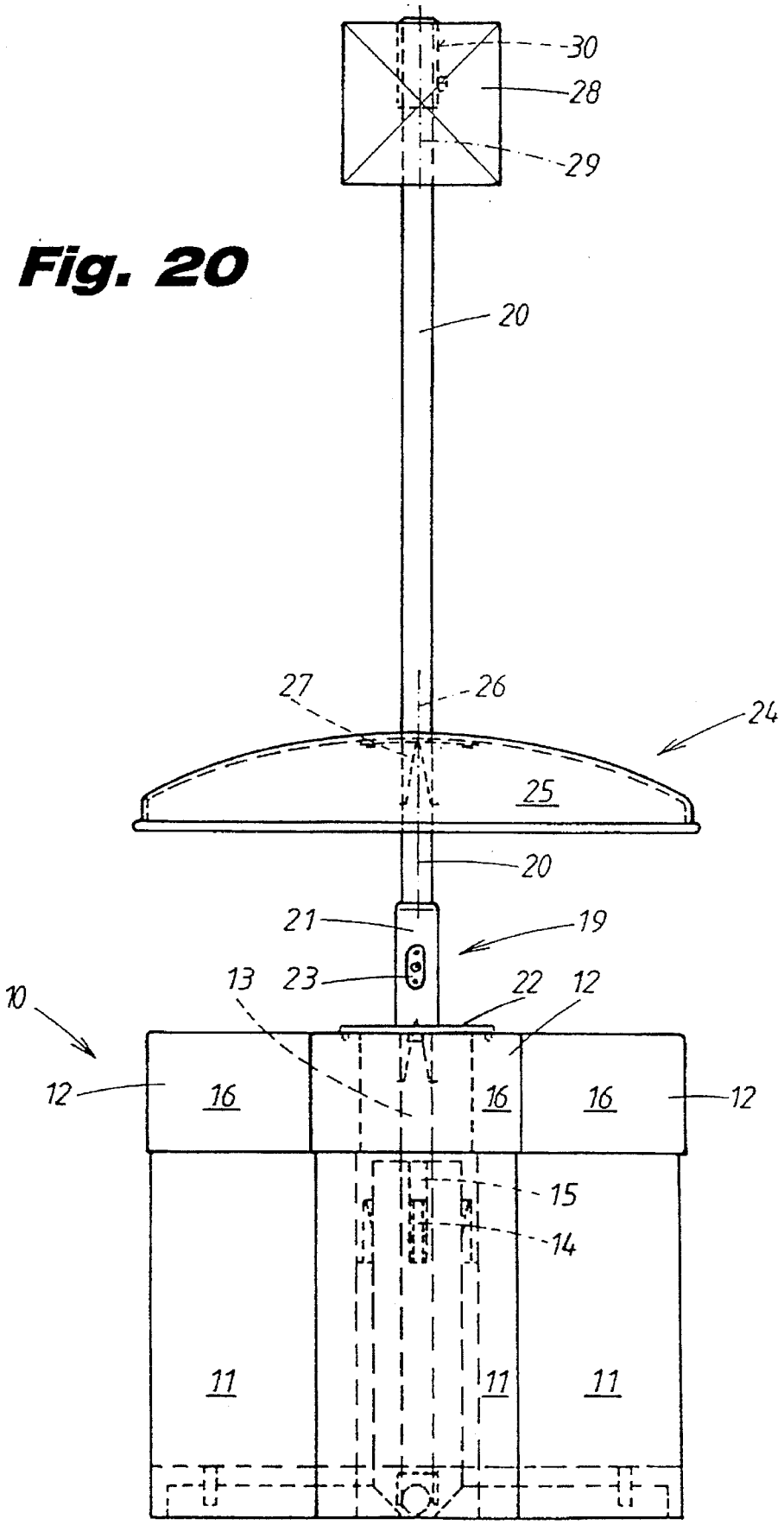
FIG. 20 shows an eighth embodiment of the unit for separating waste and valuable materials with four containers for waste, one locking device, one roof construction and one pictogram holder.

FIGS. 20 and 21 of the drawing show an eighth embodiment of the inventive unit for separating waste and valuable materials with four waste containers 11, a locking device 19, a roof construction 24 and a pictogram holder 28. As seen in plan view, the pictogram holder 28 in this case has the geometric shape of a quadrilateral to correspond to the number of waste containers 11.

Figure 22:
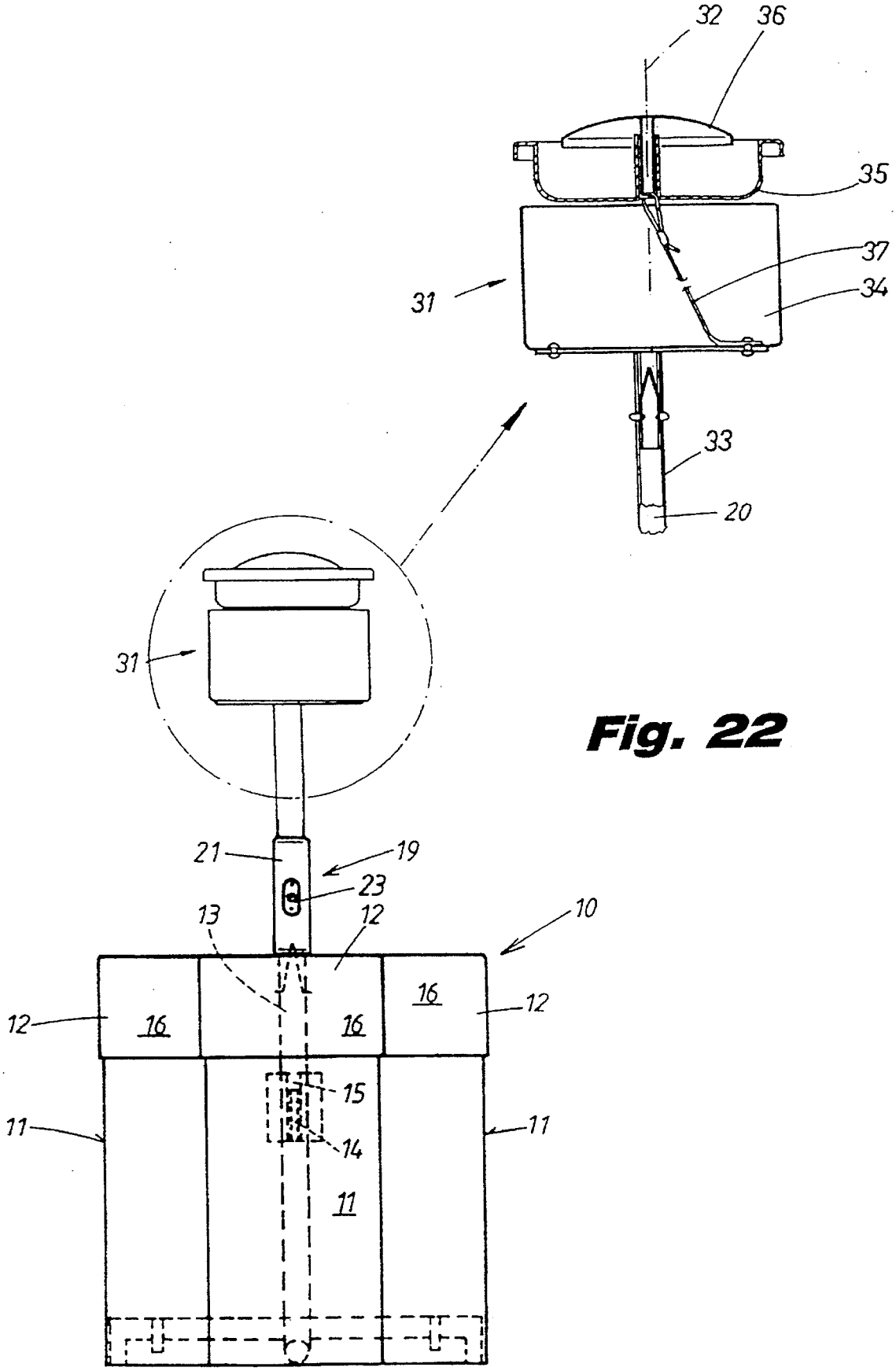
FIG. 22 shows a side view of a ninth embodiment of an inventive unit for separating waste and valuable materials with three containers for waste, one locking device and one ashtray

FIG. 22 shows a ninth embodiment of the inventive unit for separating waste and valuable materials with three waste containers 11, a locking device 19 and an ashtray 31 closing off the unit at the top. The ashtray 31 can be pushed instead of the roof construction 24 over a stay pipe 33 running along its center axis from above into the extension 20 of the unit for separating waste and valuable materials 10 and fixed there with spring-assisted securing pins. The ashtray 31 consists of an ashtray body 34 and an ashtray bowl 35, which can be placed upon the ashtray body 34. In the embodiment shown, the ashtray bowl 35 is closed off at the top by a removable covering hood 36, which can, for example, be mushroom-shaped and consists of stainless steel in the embodiment shown. Moreover, the ashtray bowl 35 is secured to the ashtray body 34 by a securing cord 37.

Figure 23:
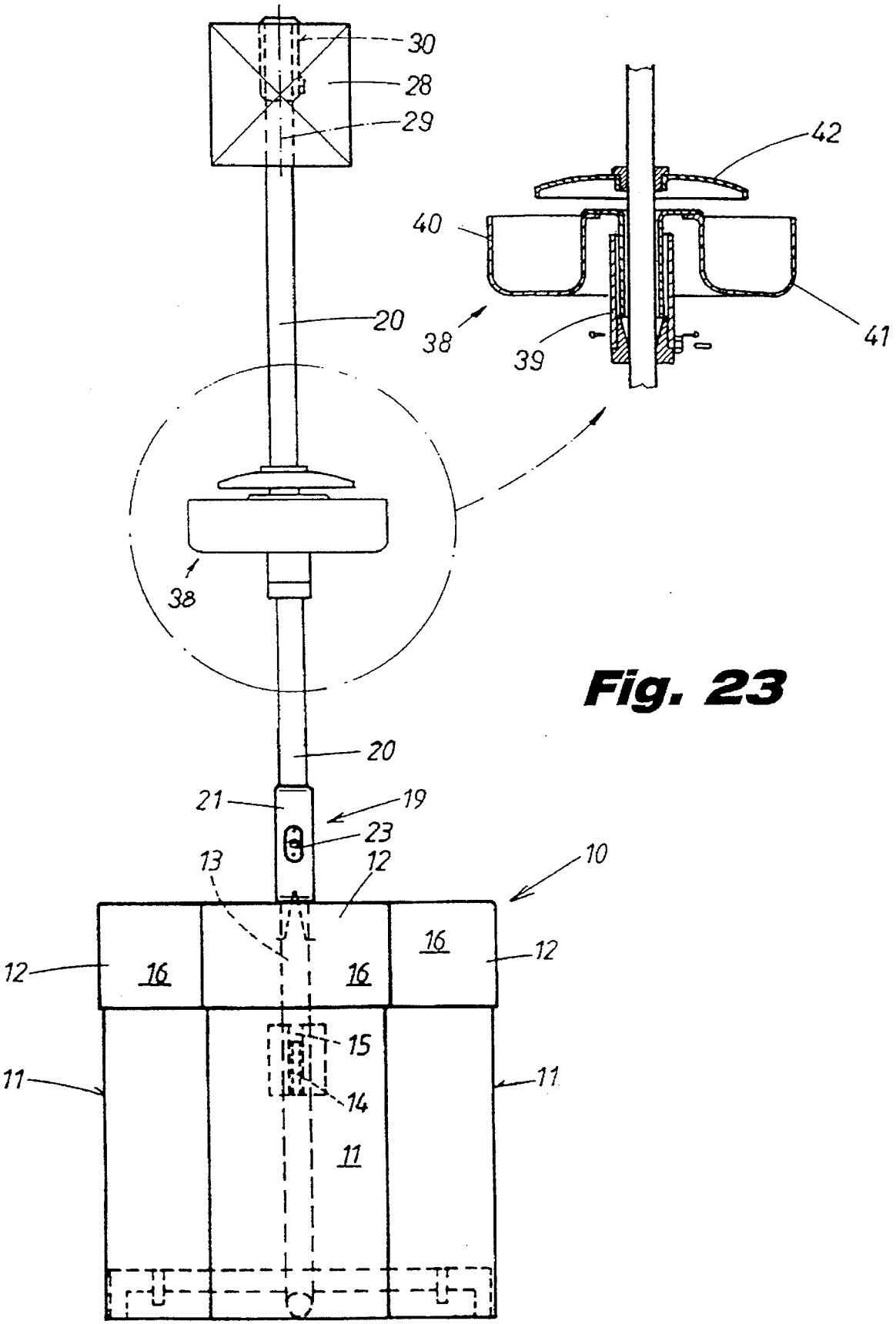
FIG. 23 shows a side view of a tenth embodiment of an inventive unit for separating waste and valuable materials with three containers for waste, one locking device, one ashtray and one pictogram holder.

FIG. 23 shows a tenth embodiment of the inventive unit for separating waste and valuable materials with three waste containers 11, a locking device 19, an ashtray 38 and a pictogram holder 28. The ashtray 38 can be positioned at any convenient height between the locking device 19 on the waste containers 11 and the pictogram holder 28 by fixing the extension 20. This is accomplished by fixing an overlapping part 39, which forms the lower part of the ashtray 38, by means of conventional fasteners, such as locking screws or pins or the like, to the extension 20. The overlapping part 39 serves for accommodating two ashtray shells 40 and 41, which in turn can be closed off and turned by means of a covering hood 42 movably fixed to the extension 20. By mounting the covering hood 42, which once again can consist of stainless steel, on the ashtray shells 40 and 41, a firm connection is produced between these and the overlapping part 39 and the whole arrangement is firmly held together in this way.

The embodiments of the unit for separating waste and valuable materials 10, shown in the Figures of the drawing, offer the possibility that persons with no mechanical skills can also carry out on the spot a modification of the unit for separating waste and valuable materials 10 without any tools, depending on the modification required of the unit for separating waste and valuable materials. For example, for adapting the capacity, a waste container 11 at the holding device of the center post 13 is unhooked and exchanged for a waste container 11 with a different capacity. Moreover, the unit can be adapted to new requirements by exchanging existing interchangeable rings 16 for interchangeable rings with a different color and a different inscription for a different fraction of valuable or recyclable materials, for example, also without changing the capacity. The inventive unit for separating waste and valuable materials 10 can thus be adapted to other circumstances without any difficulties.

As already mentioned, the embodiments shown are only examples of the realization of the invention, which is not limited to these. Rather, various modifications and constructions are possible. For example, the waste containers 11 can have a shape and size different from those shown in FIG. 10 of the drawing. Furthermore, a different arrangement of the center post, connecting the waste containers with one another in modular fashion, as well as the use of identifying means other than those shown in the Figures of the drawing, are conceivable. Moreover, it is possible for the locking device, the roof construction and the pictogram holder to have an arrangement different from that shown in the Figures of the drawing. Moreover, the present invention comprises embodiments, in which the center post is movable and also embodiments, in which the center post is replaced by other connecting elements, such as a star-shaped connecting element. Furthermore, it is planned to support the waste containers in seats intended for this purpose.

We claim:

1. A unit for separating waste and valuable materials comprising several mutually connected waste containers, each of which is equipped with identifying means comprising an interchangeable ring configured to be mounted in modular fashion on the waste container such that one end of each said ring is flanged around the upper limiting edge of an attached corresponding waste container and the other opposing end extends over an outer surface region of the attached corresponding waste container, whereby each ring labels the corresponding waste containers for the purpose of assigning a particular waste or recyclable fraction to them, characterized in that the unit for separating waste and valuable materials (10) is constructed so as to be adaptable in modular fashion.

2. The unit for separating waste and valuable materials of claim 1, characterized in that the unit for separating waste and valuable materials (10) has tubular waste containers (11).

3. The unit for separating waste and valuable materials of claim 2, characterized in that the tubular waste containers (11) of the unit for separating waste and valuable materials (10) can be assembled in modular fashion over a center post (13).

4. The unit for separating waste and valuable materials of claim 3, characterized in that the waste containers (11) interact over sliding elements (14), fastened to them, with vertical guide rails (15) disposed at the center post (13).

5. The unit for separating waste and valuable materials according to claim 1, characterized in that the unit for separating waste and valuable materials (10) has a total of three tubular waste containers (11).

6. The unit for separating waste and valuable materials according to claim 1, characterized in that the unit for separating waste and valuable materials (10) has a total of four tubular waste containers (11).

7. The unit for separating waste and valuable materials according to claim 1, characterized in that the waste containers (11) of the unit for separating waste and valuable materials (10) have a different height.

8. The unit for separating waste and valuable materials according to claim 1, characterized in that the waste containers (11) of the unit for separating waste and valuable materials (10) have a different diameter.

9. The unit for separating waste and valuable materials of claim 1, characterized in that the unit for separating waste and valuable materials (10) is equipped with a locking device (19).

10. The unit for separating waste and valuable materials of claim 9, characterized in that the locking device (19) of the unit for separating waste and valuable materials (10) consists of an extension (20) of the center post (13) and of a stay pipe (21), which can be shifted on the center post (13), interacts with the waste containers (11) and their interchangeable rings (16) and has a number of claws (22), which corresponds to the number of waste containers (11), for securing the waste containers (11) and their interchangeable rings (16), and a cylinder lock (23).

11. The unit for separating waste and valuable materials of claim 10, characterized in that the movable stay pipe (21) of the locking device (19) of the unit for separating waste and valuable materials (10) for use with waste containers (11) of different height is equipped with a number of claws (22) disposed at different heights, which number corresponds to the number of waste containers (11).

12. The unit for separating waste and valuable materials of claim 1, characterized in that the unit for separating waste and valuable materials (10) is equipped with a roof construction (24).

13. The unit for separating waste and valuable materials of claim 12, characterized in that the roof construction (24) of the unit for separating waste and valuable materials (10) is constructed as a curved, dome-shaped roof (25).

14. The unit for separating waste and valuable materials of claim 13, characterized in that the curved, dome-shaped roof (25) has along the center axis (26) a stay pipe (27), which interacts with an extension (20), which can be placed upon the center post (13).

15. The unit for separating waste and valuable materials of claim 1, characterized in that the unit for separating waste and valuable materials (10) is equipped with a pictogram holder (28).

16. The unit for separating waste and valuable materials of claim 15, characterized in that the pictogram holder (28) has along the center axis (29) a stay pipe, which interacts with an extension (20), which can be placed on the center post (13) and extends up to the eye level of the user.

17. The unit for separating waste and valuable materials of claim 1, characterized in that the unit for separating waste and valuable materials (10) is equipped with an ashtray (31).

18. The unit for separating waste and valuable materials of claim 1, characterized in that the unit for separating waste and valuable materials (10) is equipped with an ashtray (31) and a pictogram holder (28).

* * * * *

UNITED STATES PATENT AND TRADEMARK OFFICE

CERTIFICATE OF CORRECTION

PATENT NO. : 5,626,240
DATED : May 6, 1997
INVENTOR(S) : Friedrich, et al

It is certified that error appears in the above-indentified patent and that said Letters Patent is hereby corrected as shown below:

Title page, [73] Assignees: Change "LUNE OBJEKTEINRICHTUNG GmbH; LUNE METAL PRODUCTS Co. Ltd., both of Lancashire, England" to --LUNE OBJEKTEINRICHTUNG GmbH, Wuppertal, Germany; and LUNE METAL PRODUCTS Co. Ltd., Morecambe, Lancashire, England--.

Signed and Sealed this

Sixth Day of January, 1998

*Attest:*

*Attesting Officer*

BRUCE LEHMAN

*Commissioner of Patents and Trademarks*